US005547299A

United States Patent [19]

Düsterhus et al.

[11] Patent Number: 5,547,299

[45] Date of Patent: Aug. 20, 1996

[54] DEVICE FOR THE EXACT POSITIONING OF A PRINTING HEAD IN RELATION TO A RECORDING SUBSTRATE

[75] Inventors: Richard Düsterhus, Paderborn; Udo Petermann, Altenbeken; Reimund Selke, Paderborn; Ruprecht Flügge, Bad Lippspringe, all of Germany

[73] Assignee: Siemens Nixdorf Informationssysteme Aktiengesellschaft, Paderborn, Germany

[21] Appl. No.: 525,601

[22] PCT Filed: Mar. 11, 1994

[86] PCT No.: PCT/DE94/00273

§ 371 Date: Sep. 20, 1995

§ 102(e) Date: Sep. 20, 1995

[87] PCT Pub. No.: WO94/21466

PCT Pub. Date: Sep. 29, 1994

[30] Foreign Application Priority Data

Mar. 22, 1993 [DE] Germany ..... 43 09 184.9
Mar. 22, 1993 [DE] Germany ..... 43 09 185.7

[51] Int. Cl.[6] ..... B41J 29/44

[52] U.S. Cl. ..... 400/708; 400/709

[58] Field of Search ..... 400/708, 709, 400/708.1; 395/111

[56] References Cited

U.S. PATENT DOCUMENTS 4,610,445 9/1986 Schneider .
4,672,465 6/1987 Ono .
5,346,322 9/1994 Okamori ..... 400/708
5,397,192 3/1995 Khormaee ..... 400/708

FOREIGN PATENT DOCUMENTS 0139426 5/1985 European Pat. Off. .
0406236 1/1991 European Pat. Off. .
3524636 1/1986 Germany .
59140090 2/1983 Japan .
01218865 9/1989 Japan .
3-142270 6/1991 Japan .
3-197161 8/1991 Japan .

*Primary Examiner*—John S. Hilten
*Attorney, Agent, or Firm*—Hill, Steadman & Simpson

[57] ABSTRACT

A recording substrate (21) is brought into a predetermined position on a recording substrate holder (10). One edge of the recording substrate (21) rests against a recording substrate stop (18) provided at one side on the recording substrate holder (10). Extending transversely to the recording substrate stop (18), in or on the recording substrate holder (10), there is a transmitting or receiving means (KS) which can be covered by the recording substrate (21). A receiving or transmitting means (KE) is provided on the printing head (7). In the region of the extent of the transmitting or recording means (KS), at a defined distance from the recording substrate stop (18), a shielding surface (30) is arranged on the recording substrate holder (10). During the movement of the printing head (7) along the transmitting or receiving means (KS), the location of the shielding surface (30) and the location of the recording substrate edge remote from the recording substrate stop (18) are detected.

11 Claims, 4 Drawing Sheets

DEVICE FOR THE EXACT POSITIONING OF A PRINTING HEAD IN RELATION TO A RECORDING SUBSTRATE

BACKGROUND OF THE INVENTION

The invention relates to a device for the exact positioning of a printing head in relation to a recording substrate in a printer.

In a printer, recording substrates in the form of single sheets which consist of paper or plastic are transported in a recording substrate feed shaft. From the recording substrate feed shaft, the recording substrates are fed to a recording substrate holder, on which they are printed.

The recording substrate holder contains means which bring the recording substrate into a desired position on the recording substrate holder. The desired position can, for example, be achieved when one edge of the recording substrate bears on a recording substrate stop which is provided at the edge of the recording substrate holder. If the desired position is fixed in two dimensions, a second recording substrate stop, which is provided at right angles to the first recording substrate stop on a further side boundary of the recording substrate holder, can fix the desired position of the recording substrate in this second position.

Now, if the recording substrate lies with its edges on the recording substrate stops, the printing process can be carried out under the precondition that the position of the recording substrate holder in relation to the printing head and the format of the recording substrate are known.

Normally, printers process recording substrates in a standard format or the format respectively being used must be preselected by am operator. A further possibility of determining the format of the recording substrate consists in guiding a sensor, operating according to the light reflection principle, over the recording substrate holder. In this arrangement, use is made of the different reflection properties of the recording substrate and of the recording substrate holder. Unprinted recording substrates reflect the light much more strongly than the surface of the recording substrate holder. However, problems always arise with this reflection light barrier if a recording substrate has already been printed in part regions before the printing process, that is to say, for example, contains a form which is intended to be filled out by means of the current printing process, or if the reflective capability of the recording substrate differs from common recording substrates, for example because of a particular coloration of its entire surface or of its edges.

The assignment of the recording substrate holder to the printing head is effected by means of a reduction in the geometric tolerances between the printing head mechanism and the recording substrate holder. This tolerance Japanese reference JP 3-197161 discloses a device for positioning a printing head using different reflection properties of a paper, a reflection rail and an end marker. A photosensor and a printing head are arranged together in a moving carrier.

Japanese reference JP 3-142270 discloses to deposit a recording substrate on a recording substrate holder and to determine the position of the recording substrate by means of sensors operating according to the reflection principle. The sensors are arranged together with a printing head in a carrier.

European reference EP 0 406 236 B1 discloses an optical measuring device by means of which the lateral deposition of a recording substrate can be determined. On a displaceable carrier, a transmitting and receiving element are arranged opposite each other in such a manner that a recording substrate which is brought into their beam path is detected.

IBM Technical Disclosure Bulletin, Vol. 28, No. 4, September 1985, pages 1681–1683, discloses an arrangement for determining the position of a printed sheet. The arrangement operates according to the transmission principle, an LED being provided as transmitting means and a row of photo-transistors as receiving means. The printed sheet is guided between transmitting and receiving means and the position is determined by scanning the phototransistors. The distance between the individual phototransistors is limited to a minimum distance by the size of the components and, for this reason, the position of the printed sheet can be determined only with a relatively coarse resolution, reduction is complicated and expensive.

The present invention is then based on the object of providing a device for the exact positioning of a printing head in relation to a recording substrate in a printer, which makes it possible to assign the position of the printing head and of the printable region of the recording substrate exactly to each other, in order that the printed characters can be imaged with high reliability at the desired positions.

In general terms the present invention is a device for the exact positioning of a printing head in relation to a recording substrate in a printer.

The recording substrate is deposited on a recording substrate holder and is aligned on at least one recording substrate stop bounding the recording substrate holder on one side. The printing head is moveable in at least one direction transverse to the recording substrate stop over the recording substrate holder. At least one receiving or transmitting means which can be moved together with the printing head is coupled in a defined position with the printing head. At least one transmitting or receiving means, which extends in the movement direction of the printing head, is arranged in or on the recording substrate holder in such a way that the transmitting or receiving means can be covered over at least partially by the recording substrate. As a result, a communication between the receiving or transmitting means and the transmitting or receiving means may be interrupted in the deposit region of the recording substrate.

Advantageous developments of the present invention are as follows. The recording substrate holder has a shielding surface which is arranged at a defined distance from the recording substrate stop and in the region of the extent of the transmitting or recording means. The shielding surface is suitable for interrupting communication between the receiving or transmitting means and the transmitting or receiving means.

The transmitting or receiving means assigned to the recording substrate holder is arranged underneath the recording substrate holder. The recording substrate holder is formed by a flat plate which is transparent, at least in the region of the extent of the transmitting or receiving means.

The transmitting means assigned to the recording substrate holder has a plurality of light-emitting diodes which are lined up as an LED row and arranged on a flat subassembly. Between the recording substrate holder and the LED row, a light conducting means is provided. The light conducting means is formed by a shaft which is connected in one piece to the recording substrate holder. The light-emitting diodes are arranged at such a distance from one another that the radiation cones of adjacent light-emitting diodes partially overlap at the surface of the recording substrate holder.

The receiving or transmitting means which can be moved together with the printing head is assigned a slit diaphragm.

In the region of the surface of the recording substrate holder, a refraction means is provided that deflects the beam path by an angle between receiving and transmitting means.

To align the recording substrate, at least one further transmitting means and one further receiving means are provided. The further transmitting means is arranged on one side of a recording substrate holder and the further receiving means is arranged on the other side of the recording substrate holder such that the main reception direction of the receiving means is located in the region of influence of a main emission direction of the transmitting means. The recording substrate can be brought between the transmitting means and the receiving means. The axis of the main emission direction of the transmitting means is at an oblique angle to the recording substrate holder. The transmitting means is fastened below the recording substrate holder to the flat plate. The receiving means is fastened in a cover over the recording substrate holder. The cover can be pivoted about a pivot into a locking position in which the axis of the main emission direction of the transmitting means and of the main reception direction of the receiving means align.

The distance of an edge of the recording substrate, lying opposite the recording substrate stop, from the recording substrate stop and hence the format of the recording substrate is not determined according to the reflection principle but according to the transmission principle. This improves the reliability of the format detection. The direct assignment of the receiving or transmitting means to the printing head makes possible a positioning of the printing head within close tolerance limits.

According to a further development and refinement of the invention, the recording substrate holder has a shielding surface which is arranged at a defined distance from the recording substrate stop and in the region of the extent of the transmitting or receiving means, and which is suitable for interrupting a communication between the receiving means or transmitting means and the transmitting or receiving means. The printing head is guided transversely to the recording substrate stop over the recording substrate holder, proceeding from a rest position. In the course of this movement, the transmitting and receiving means which are assigned to the printing head and to the recording substrate holder communicate with each other. For example, one side emits light, while the other side receives this light. A change in the light intensity is detected by the receiving means and communicated to a control unit.

Proceeding from the rest position, the printing head, and hence also its transmitting or receiving means, passes into the region of influence of the shielding surface. During the transition from the shielding surface to the non-shielded part of the recording substrate holder, a message is accordingly given to the control unit. Since the distance between the recording substrate stop and the shielding surface is now known, conclusions can now be drawn about the mutual position of the printing head and the recording substrate holder. In the course of the movement of the printing head, both the exact position of the edge of the recording substrate resting on the recording substrate stop and the edge, lying opposite the recording substrate stop, of the recording substrate are accordingly known in terms of their exact position. The control unit is therefore capable of guiding the printing head with high reliability to exactly those positions at which characters or the like are intended to be printed.

According to a further development and refinement of the invention, the transmitting or receiving means assigned to the recording substrate holder is arranged underneath the recording substrate holder. The recording substrate holder is in this case formed by a flat plate which is transparent to the radiation proceeding from the transmitting means, at least in the region of the extent of the transmitting or receiving means. As a result, no apertures or depressions, which can accommodate the transmitting or receiving means, need to be introduced into the recording substrate holder. In the case of a flat plate which has no apertures or depressions, a deposit of recording substrate residues in the apertures or depressions cannot occur. Rather, a self-cleaning effect occurs as a result of the recording substrate being moved over the flat plate. The functional reliability of the device is thereby improved.

According to a further development and refinement of the invention, a guiding means is provided between the recording substrate holder and the transmitting or receiving means assigned to the recording substrate holder. This guiding means enables the arrangement of the transmitting or receiving means at a distance from the recording substrate holder and additionally effects a restriction of the cross section of the beam path between the transmitting and receiving means. The beams from the transmitting means can consequently be directed exactly onto the receiving means. Particularly good guiding properties are achieved by means of a single-piece connection of the light guiding means to the recording substrate holder. The exact alignment of the radiation is also optimized.

According to a further development and configuration, the recording substrate holder has assigned to it as transmitting means a plurality of light-emitting diodes which are lined up as an LED row and are arranged on a flat subassembly. By means of the arrangement on the flat subassembly, cost-effective production by means of automatic population is made possible. An alignment of the individual light-emitting diodes in the direction of the light guiding means needs to be carried out only within wide tolerance limits. These tolerance limits can be maintained in the case of automatic population without subsequent machining. A light-emitting diode has an emission angle of ±20°, while the light guiding means detects an emission region of only ±10° from the light-emitting diodes and forwards it to the surface of the recording substrate holder. The light guiding shaft accordingly ensures that, in the case of an oblique position of the LEDs of ±10° no impairment of the functioning occurs.

By means of an arrangement of the light-emitting diodes at such a distance from one another that the radiation cones of adjacent light-emitting diodes partially overlap at the surface of the recording substrate holder, on the one hand a uniform light intensity at the surface of the recording substrate holder is achieved and, on the other hand, the failure of a single light-emitting diode can be compensated by the directly adjacent serviceable light-emitting diodes.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
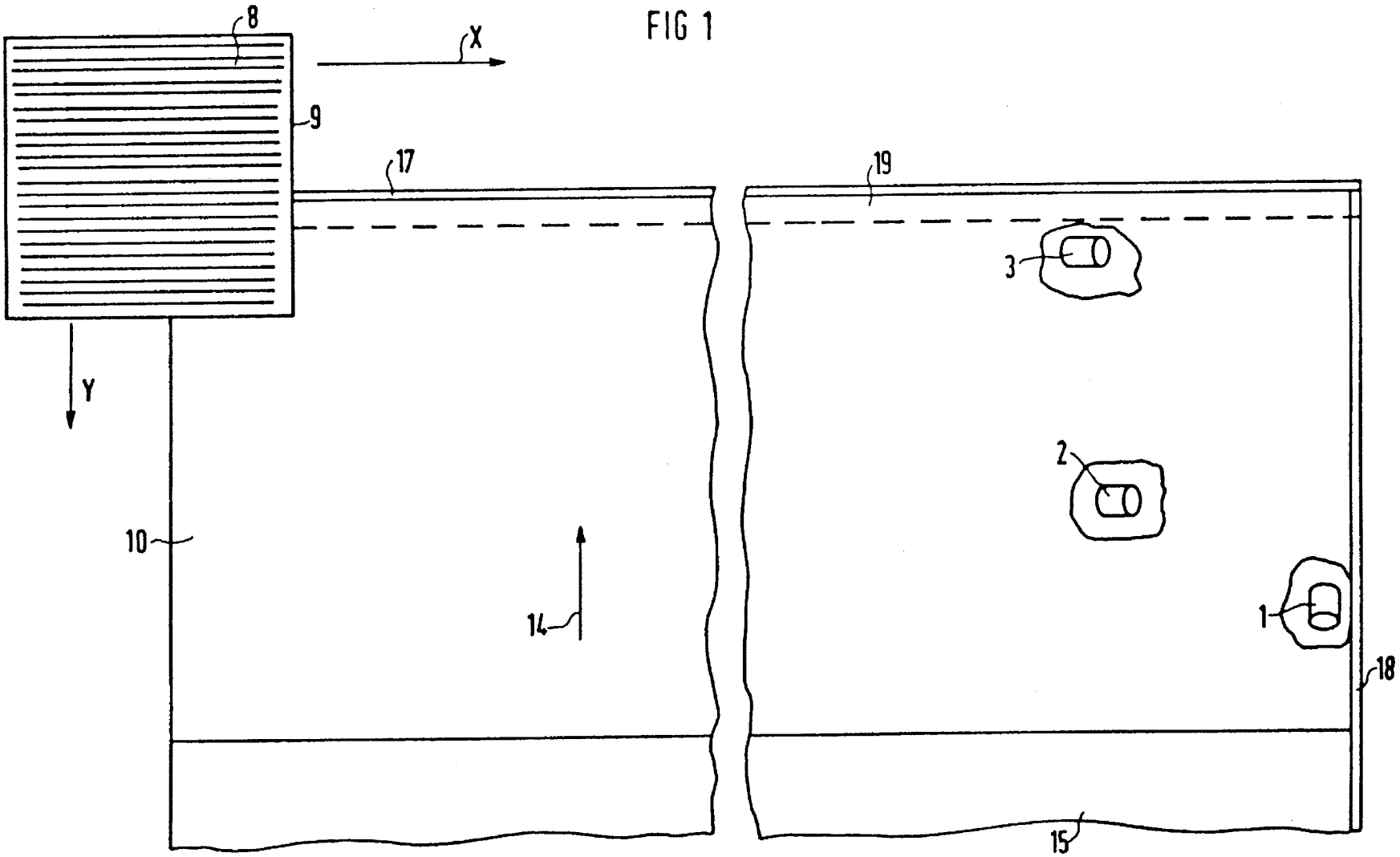
FIG. 1 shows in top view a recording substrate holder plane having a printing head slide.

FIG. 1 shows a document holder 10 of a document printer in top view. The document holder 10 is formed by a flat plate. The document holder 10 comprises a glass-clear thermosetting plastic (Makrolon). The rectangular plate has, on two sides at right angles to each other, documents stop 17, 18 projecting beyond the plate at a right angle to the document holder plane 10.

A document 21 which is transported along a document feed shaft 15 in a document feed direction 14 towards the document holder 10 (see FIG. 3) is aligned, by an aligning unit (not shown), on the rear document stop 17 which extends transversely, that is to say at a right angle to the document feed direction 14, and on the side document stop 18 which extends parallel to the document feed direction 14. The aligned document 21 can be printed with the aid of a printing head 7 which can be moved in a direction X and a direction Y and is carried by a slide 9 (see FIG. 3). The slide 9 contains on its upper side a heat sink 8 which dissipates the power loss of the needle printing head 7.

Underneath the flat plate of the document holder 10, three transmitting LEDs (Light Emitting Diodes) 1, 2, 3 are arranged. A first transmitting LED 1 is located close to the side document stop 18. A second transmitting LED 2 is arranged at a distance both from the rear document stop 17 and from the side document stop 18. A third transmitting LED 3 is arranged close to the rear document stop 17. A document 21 which is fed in the document feed direction 14 to the document holder 10 first covers the second transmitting LED 2, whereupon the alignment device seizes the document 21 and pushes it towards the rear and to the side document stop 17, 18, until the first transmitting LED 1 and the third transmitting LED 3 are covered by the document 21.

Figure 5:
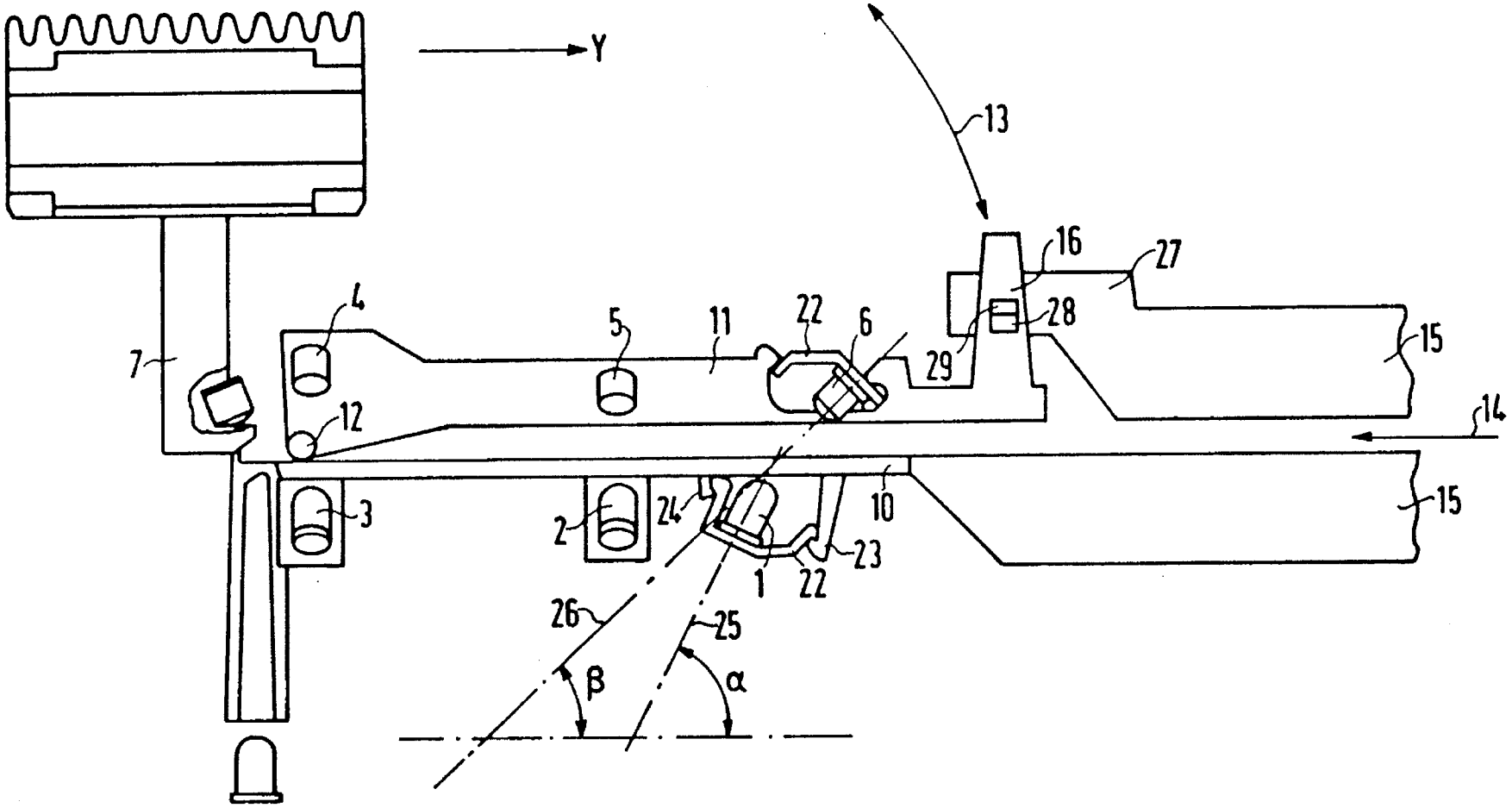
FIG. 5 shows a side view of the recording substrate holder plane with a schematic representation of a device for detecting the presence of the recording substrate.

As shown in FIG. 5, each transmitting LED 1, 2, 3 cooperates with a receiving LED 4, 5, 6. The first receiving LED 6 is in this case assigned to the first transmitting LED 1, the second receiving LED 5 to the second transmitting LED 2 and the third receiving LED 4 to the third transmitting LED 3.

The arrangement and the functioning of the paired transmitting and receiving LEDs 1, 2, 3, 4, 5, 6 are now explained using the example of the first transmitting LED 1 and the first receiving LED 6. The first transmitting LED 1 is fastened on a plastic molding 22 in a defined position. The plastic molding 22 has two ends of hook-like design which project laterally from the first transmitting LED 1. These ends can be locked into locking hooks 23, 24 which protrude on the underside of the flat plate of the document holder 10. In the locked-in condition, the line of symmetry of the first transmitter LED 1, which is identical to the axis of the main emission direction 25 of this transmitting LED 1, is at an angle $\alpha$ with respect to the document holder plane 10. The first receiving LED 6 is arranged above the flat plate of the document holder 10. Like the first transmitting LED 1, the first receiving LED 6 is fixed on a plastic molding 22. This plastic molding 22 can be locked in a positive manner in a defined position in a document holder cover 11. In the locked-in condition, the line of symmetry of the first receiving LED 6, which is identical to the axis of the main reception direction 26 of the receiving LED 6, is at an angle $\beta$ with respect to the flat plate of the document holder 10. The oblique positioning of the transmitting and receiving LEDs 1–6, as explained in more detail below, effects an increased reflection at the document 21 and a virtual thickening of the document 21.

When the radiation generated by the first transmitting LED 1 passes through the flat plate, a refraction occurs which refracts the axis of the main emission direction 25 from the angle $\alpha$ into the angle $\beta$. The axis of the main reception direction and of the main emission direction are then aligned in the region above the flat plate of the document holder 10. For example, the angle $\alpha$ is 64 degrees and the angle $\beta$ is 45 degrees. The distance of the lower edge of the first receiving LED 6 from the surface of the document holder 10 must be at least as great as the maximum thickness of the documents 21 to be processed.

The remaining receiving LEDs 4, 5 are also fixed in the document holder cover 11. Together with the document holder cover 11, these can be pivoted in the pivoting direction 13 away from the surface of the document holder 10 about an axis of rotation 12 extending parallel to the rear document stop 17. In the pivoted-away condition of the document holder cover 11, the document holder 10 can be cleaned or damaged documents can be removed. On pivoting back the document holder cover 11 into the desired position, its end lying opposite the axis of rotation 12 locks in a locking part 27 protruding from the document feed shaft 15. For this purpose, the document holder cover 11 has in the said region a tab 16 into whose aperture 28 a lug 29 of the locking part 27 penetrates.

After the conclusion of the alignment process, the document 21 has reached its desired position on the document holder 10. To print the document, the printing head 7 can be guided over the document holder 10 in a direction X and a direction Y, with the aid of a slide drive AN (see FIG. 4). The direction Y coincides with the document feed direction 14, whereas the direction X is at right angles to both these directions 14, Y. In order to ensure exact printing of the document 21 at the points provided therefor, a device for the exact positioning of the printing head 7 is provided. This device is capable of detecting different formats of documents 21 and the position of the document holder 10 in relation to the printing head 7.

The capability of detecting the geometrical position of the document holder 10 in relation to the printing head 7 is advantageous inasmuch as complicated adjustment of the printing head 7 in relation to the document holder 10 can be dispensed with. The geometrical position of the document holder 10 in relation to the printing head 7 must therefore be known, since two mutually rectangular edges of the document 21 rest on the side and on the rear document stop 17, 18 and hence the position of the document 21 in relation to the printing head 7 depends on the position of the document holder 10.

Since documents 21 of different widths and hence of different format are optionally intended to be printed, without making a format preselection necessary, the beginning of the document 21 in the direction X is registered. In the direction X, the document 21 begins at the detected point and ends at the side document stop 18. The dimension of the document 21 in the direction Y is predetermined in this example and therefore does not need to be detected in this exemplary embodiment. However, a registration of this document dimension would also be possible using a further device of the type described below.

Figure 2:
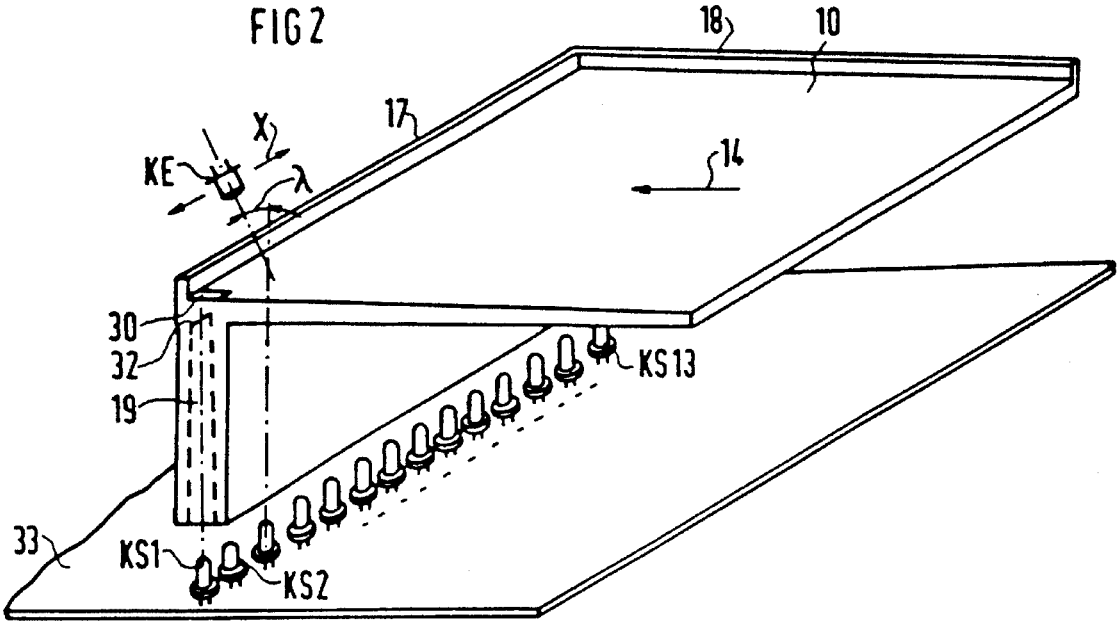
FIG. 2 shows a schematic perspective representation of a device for the exact positioning of a printing head in relation to a recording substrate.

As shown in FIG. 2, the document holder 10 contains, apart from the documents stops 17, 18 projecting upward beyond the plate, a light shaft 19 which is produced in one piece with the flat plate of the document holder 10 and introduced in a rectangular element. The rectangular element consequently consists, just like the document holder 10, of light-transparent Makrolon. The rectangular element extends in the direction X on the underside of the flat plate in the region of the rear document stop 17. The light shaft 19 is located in the interior of this rectangular element.

The light shaft 19 is a longitudinal groove which extends from that longitudinal side of the rectangular element which is remote from the flat plate of the document holder 10, in the direction of the flat plate. The longitudinal groove has a trapezoidal shaft cross section which tapers in the direction of the flat plate of the document holder 10. The groove base 32, located in the region of the flat plate, extends in the longitudinal direction parallel to the flat plate. However, the groove base 32 is inclined in a direction at right angles to the longitudinal direction, so that the first trapezoidal limb—seen from the paper feed direction 14—is longer than the second trapezoidal limb of the light shaft 19. The groove base 32 is hence aligned obliquely with respect to the flat plate of the document holder 10. Light guided in the light shaft 19 and directed towards the flat plate is refracted through an angle $\lambda$ by the prism which is formed by the groove base 32 in cooperation with the flat plate. This angle $\lambda$ is 26°. To optimize the light guiding and light refraction, the surfaces of the light shaft and of the flat plate are polished.

The light guided in the light shaft 19 is generated using an LED row KS. The individual LEDs KS1 . . . 13 of the LED row KS are arranged on a flat subassembly 33 which extends underneath the document holder 10, parallel to the latter. The light emitted by this LED row KS is guided in the light duct 19 to the surface of the document holder 10 and is there registered by a light-sensitive receiving diode KE. In the region in which a document 21 lies on the document holder 10, the emergence of light is prevented at the covered points of the document holder 10 and thus communication between LED row KS and receiving diode KE is prevented.

Such an emergence of light is prevented at another point. In the region of that side of the document holder 10 lying opposite the side document stop 18, the surface of the flat plate is blackened in the opening region of the light shaft 19, for example by means of the application of ink. The distance between the mutually facing edges of this blackening 30 and the side document stop 18 is fixed by a fixed amount, so that knowledge of the position of the blackening 30 also implies knowledge of the position of the side document stop 18.

Figure 3:
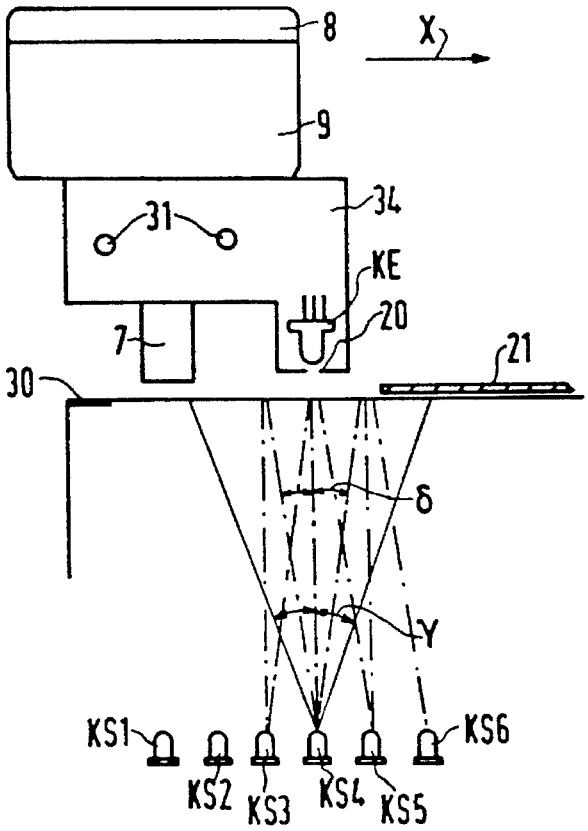
FIG. 3 shows in a front view a schematic representation of the device for the exact positioning of a printing head in relation to a recording substrate.

As can be seen from FIG. 3, the receiving diode KE is assigned to the movable slide of the printing head 7. The receiving diode KE is fastened in a diode carrier 34. The diode carrier 34 surrounds the receiving diode KE completely and has a slit aperture 20 through which light coming from the LED row KS can penetrate as far as the receiving diode KE. The distance between the slit aperture 20, which is approximately 0.5 mm wide, and the printing head 7 is fixed by means of an accurately-fitting fastening of the diode carrier 34 on the slide 9. The diode carrier 34 is fastened on the slide 9 by means of register pins 31 and a screw connection which is not shown. An exact assignment of the printing head 7 to the receiving diode KE can also be effected by the diode carrier 34 also being used as carrier for the printing head 7.

A section of the diode row KS is also shown in FIG. 3. The individual LEDs KS1 . . . 6 . . . 13 are arranged adjacent to each other at a uniform distance (7.62 mm) from one another, for example by means of automatic population. Each of the LEDs KS1 . . . K13 emits light upward in the perpendicular direction from the flat subassembly 33 into the light shaft 19. The emission angle $\gamma$ is about ±20°. The distance between the LEDs KS1 . . . 6 . . . 13 and from the LEDs to the surface of the document holder 10 is selected such that the light cones from adjacent LEDs KS1 . . . 6 . . . 13 overlap at the surface of the document holder 10, in each case by one half. The relevant emission angle $\delta$ for this light cone overlap is ±8°. As a result of this type of arrangement of the LEDs KS1 . . . 6 . . . 13, a uniform irradiation intensity results at the receiving diode KE, which is imperative for reliable functioning. The light shaft 19 registers only a section of ±10° of the light cone of ±20° emitted by the LEDs KS1 . . . 6 . . . 13. As a result, inclined positions of up to ±10° of the LEDs KS1 . . . 6 . . . 13 during the population is unimportant for the functioning of the device. As a result of the overlapping of the light cones of adjacent LEDs KS1 . . . 6 . . . 13, the failure of individual LEDs KS1 . . . 6 . . . 13 can be compensated if the directly adjacent LEDs KS1 . . . 6 . . . 13 of the failed LEDs KS1 . . . 6 . . . 13 are intact.

Figure 4:
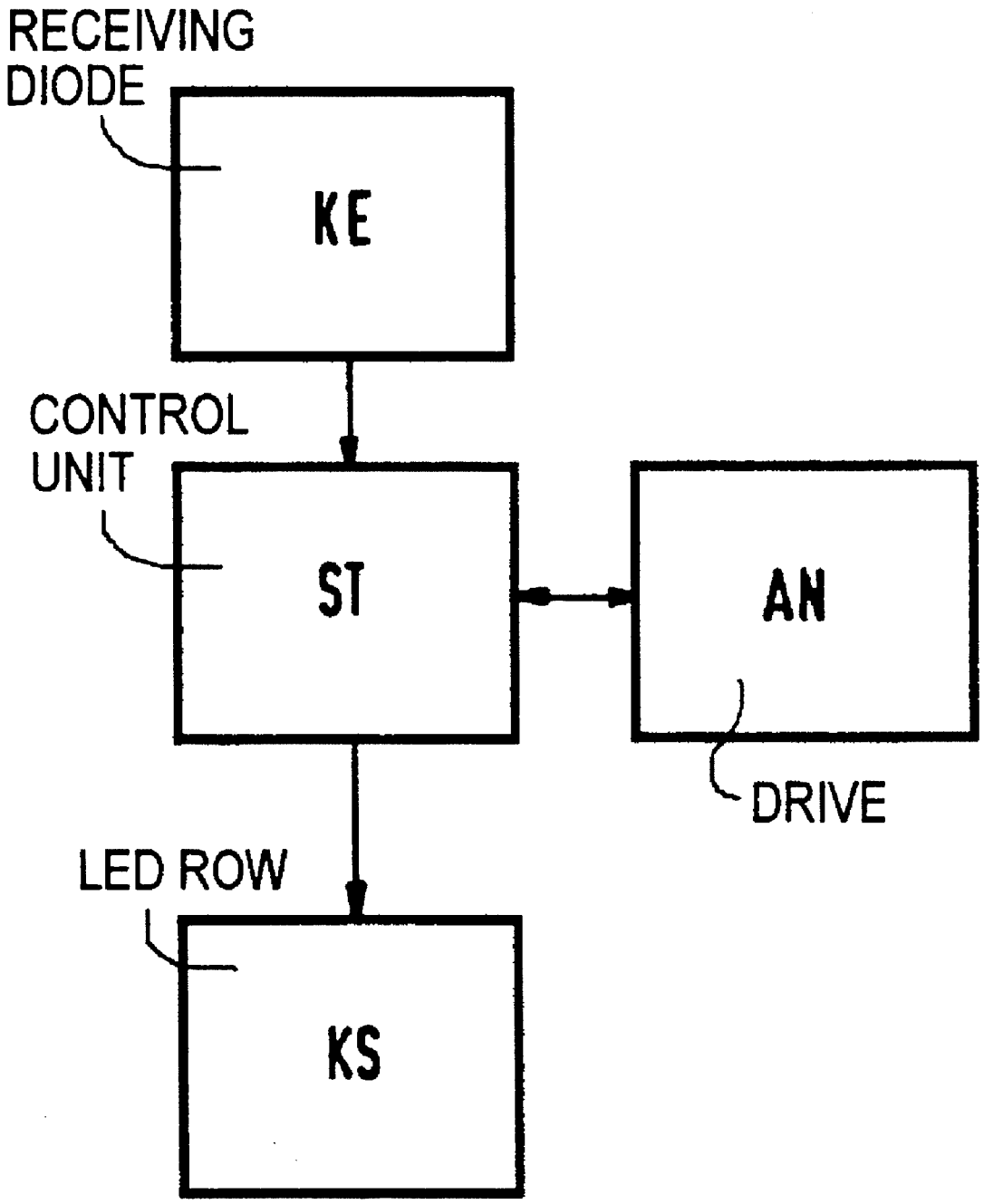
FIG. 4 shows a block diagram of a drive means of the printing head.

FIG. 4 shows a block diagram of a drive means of the printing head. A control unit ST controls the motorized slide drive AN which moves the printing head 7. The slide drive AN reports the current actual positional data of the printing head 7 to the control unit ST. The control unit ST is connected to the receiving diode KE and the LED row KS. The receiving diode KE emits a pulse to the control unit ST when a strong light/dark change, for example during the passage of the blackening 30, occurs. The control unit ST is therefore capable of registering exactly the position of the blackening 30 and the position of that side of the document 21 remote from the side document stop 18.

After a document 21 has been deposited on the document holder 10 and is aligned on the document stops 17, 18, the control unit ST activates the motorized slide drive AN. At the instant of activation, the slide 9 is located in a basic position. This basic position can be seen from FIG. 1. In this basic position, the receiving diode KE and the printing head 7 are not located over the document holder 10. The slide 9 is firstly moved in the direction X along the rear document stop 17 over the light exit region of the light shaft 19. The distance between the light exit surface of the light shaft 19 (and hence approximately the distance between the surface of the document holder 10) and the receiving diode KE is in this case about 3 mm. Initially, the receiving diode KE moves over the blackening 30. During the transition from the blackening 30 to the polished light exit region of the light shaft 19, there occurs a strong light intensity change. The receiving diode KE transmits a corresponding signal to the control unit ST. At the instant of this signal, the printing head 7 is in a standardization position with reference to the document holder 10. The distance between the printing head 7 and the side document stop 18, and hence the distance of the printing head 7 from the document edge resting on the side document stop 18 is thus known. From the mechanical and optical parameters of the construction results a maximum theoretical measurement error of 0.2 mm for the document edge.

The receiving diode KE is moved further in the direction X. In this case, the receiving diode KE receives the light refracted in its main reception direction. The refraction angle λ is 26° in this case with reference to an axis perpendicular to the document holder 10.

As a result of the refraction of the transmitted light at the refraction angle λ in relation to the document holder plane, the transmitted radiation is incident on the document 21 at an oblique angle. In the case of a film-like document 21, this effects an increased radiation reflection in comparison with a rectangular incidence of the radiation. Even in the case of a document 21 which is relatively transparent to radiation, such as for example thin paper, a smaller proportion of the radiation passes to the receiving diode KE, because of the refraction angle λ. In addition, the path of the radiation through the document material is extended. The document 21 becomes virtually thicker. If, for example, the document thickness is 0.1 mm and the refraction angle λ is 26 degrees in relation to the document holder 10, then according to the relationship $$\text{Document thickness} \times (1/\sin\lambda) = \text{virtual document thickness}$$

the virtual document thickness is 0.1113 mm. A thickening of the document 21 leads to a reduced transparency of the document 21 to the radiation emitted by the LED row KS. In the case of documents 21 having a fibrous structure, the effect of the virtual thickening of the document 21 is reinforced, since an increased number of fibers is located in the beam path.

When the receiving diode KE reaches that document edge which is remote from the side document stop 18, a strong light/dark change occurs at the receiving diode KE, just like when passing the blackening 30. The receiving diode KE in turn reports this to the control unit ST, as a result of which the format and the beginning of the document 21 become known. Consequently, the document 21 can be printed with high accuracy at the points provided therefor.

List of reference symbols

1,2,3=Transmitting LED
4,5,6=Receiving LED
7=Printing head
8=heat sink
9=Slide
10=Document holder
11=Document holder cover
12=Axis of rotation
13=Pivoting direction
14=Document feed direction
15=Document feed shaft
16=Tab
17=Rear document stop
18=Side document stop
19=Light shaft
20=Slit aperture
21=Document
22=Molding
23, 24=Locking hooks
25=Main emission direction
26=Main reception direction
27=Locking part
28=Recess
29=Lug
30=Blackening
31=Register pins
32=Groove bottom/refraction means
33=Flat subassembly
34=Diode carrier
AN=Slide drive
KE=Receiving diode
KS=LED row
KS1 . . . 13=LED
ST=Control unit
X,Y=Direction of movement of the printing head slide
α=Transmitting LED angle
β=Receiving LED angle
δ=Relevant emission angle
γ=Emission angle
λ=Refraction angle The invention is not limited to the particular details of the apparatus depicted and other modifications and applications are contemplated. Certain other changes may be made in the above described apparatus without departing from the true spirit and scope of the invention herein involved. $I_t$ is intended, therefore, that the subject matter in the above depiction shall be interpreted as illustrative and not in a limiting sense.

We claim:

1. A device for exact positioning of a printing head in relation to a recording substrate in a printer, a recording substrate holder for holding the recording substrate at least one recording substrate stop bounding the recording substrate holder on one side thereof for aligning the recording substrate on the recording substrate holder, the printing head being moveable in at least one movement direction transverse to the recording substrate stop over the recording substrate holder, at least one receiving or transmitting means which is moveable together with the printing head, being coupled in a defined position with the printing head, at least one transmitting or receiving means, which extends in the movement direction of the printing head, being arranged in or on the recording substrate holder such that the transmitting or receiving means is at least partially covered by the recording substrate, as a result of which communication between the receiving or transmitting means and the transmitting or receiving means is interruptable in a deposit region of the recording substrate.

2. The device as claimed in claim 1, wherein the recording substrate holder has a shielding surface which is arranged at a defined distance from the recording substrate stop and in a region of the extent of the transmitting or recording means, and which interrupts communication between the receiving or transmitting means and the transmitting or receiving means.

3. The device as claimed in claim 1, wherein the transmitting or receiving means assigned to the recording substrate holder is arranged underneath the recording substrate holder, and wherein the recording substrate holder is formed by a flat plate which is transparent, at least in the region of the extent of the transmitting or receiving means.

4. The device as claimed in claim 1, wherein a transmitting means of the transmitting or receiving means assigned to the recording substrate holder has a plurality of light-emitting diodes which form an LED row and which are arranged on a flat subassembly.

5. The device as claimed in claim 4, wherein, between the recording substrate holder and the LED row, a light conducting means is provided.

6. The device as claimed in claim 5, wherein the light conducting means is formed by a shaft which is integral to the recording substrate holder.

7. The device as claimed in claim 6, wherein the light-emitting diodes are arranged at a distance from one another such that radiation cones of adjacent light-emitting diodes partially overlap at a surface of the recording substrate holder.

8. The device as claimed in claim 1, wherein the receiving or transmitting means, which is moveable together with the printing head, has a slit diaphragm.

9. The device as claimed in claim 1, wherein in a region of the surface of the recording substrate holder, there is provided a refraction means which deflects the beam path between receiving and transmitting means by an angle.

10. The device as claimed in claim 9, wherein the device further comprises, to align the recording substrate, at least one further transmitting means and one further receiving means, the further transmitting means being arranged on one side of the recording substrate holder and the further receiving means being arranged on the other side of the recording substrate holder such that a main reception direction of the receiving means is located in a region of influence of a main emission direction of the transmitting means, and wherein the recording substrate is brought between the further transmitting means and the receiving means an axis of the main emission direction of the transmitting means being at an oblique angle to the recording substrate holder.

11. The device as claimed in claim 10, wherein the further transmitting means is fastened below the recording substrate holder, the further receiving means is fastened in a cover over the recording substrate holder, and the cover being pivotable about a pivot into a locking position in which axis of the main emission direction of the further transmitting means align with a main reception direction of the further receiving means.

* * * * *